US005504342A

United States Patent [19]

Jaynes et al.

[11] Patent Number: 5,504,342

[45] Date of Patent: Apr. 2, 1996

[54] INLINE HANDRAIL BLACKLIGHT

[76] Inventors: Curtis B. Jaynes, P.O. Box 1871, Corbin, Ky. 40702; Darwin B. Jaynes, P.O. Box 761, Woodbine, Ky. 40771

[21] Appl. No.: 302,269

[22] Filed: Sep. 8, 1994

[51] Int. Cl.[6] ..... H01K 1/24

[52] U.S. Cl. ..... 250/504 R; 43/17.5

[58] Field of Search ..... 250/504 R, 493.1, 250/494.1, 462.1, 461.1; 43/17.5

[56] References Cited

U.S. PATENT DOCUMENTS

| | | | |
|---|---|---|---|
| 1,298,362 | 3/1919 | Lewry . | |
| 2,498,942 | 2/1950 | Cones | 240/4 |
| 2,825,796 | 3/1958 | Lanmon | 240/2 |
| 3,064,122 | 11/1962 | Reeder, Jr. | 240/7.5 |
| 3,554,782 | 12/1970 | Hahn | 240/2 |
| 4,161,769 | 7/1979 | Elliott | 362/146 |
| 4,515,393 | 5/1985 | Sauter | 280/756 |
| 4,621,447 | 11/1986 | Rhodes | 43/17.5 |

*Primary Examiner*—Jack I. Berman
*Assistant Examiner*—Kiet T. Nguyen
*Attorney, Agent, or Firm*—Dickinson, Wright, Moon, Van Dusen & Freeman

[57] ABSTRACT

The present invention is a novel handrail that is equipped with an ultraviolet bulb and is useful as an accessory in night time fishing. The handrail may be permanently mounted on the deck of a fishing vessel, and is constructed so that the ultraviolet bulb faces outward from the hull of the boat and causes fluorescent fishing line disposed in the immediate vicinity of the hull to fluoresce. The handrail is provided with fastener for directing the orientation of the bulb, and is also provided with a protective cover that is substantially transparent to ultraviolet light and that protects the bulb from the elements.

14 Claims, 1 Drawing Sheet

INLINE HANDRAIL BLACKLIGHT

TECHNICAL FIELD

This invention relates generally to the art of utility lights, and in particular to a novel ultraviolet fishing light that is incorporated into the handrail of a fishing vessel.

BACKGROUND

It is known to use lights as accessories in night fishing. For example, U.S. Pat. No. 3,064,122 discloses a lamp used for illuminating nocturnal fishing operations and for attracting fish.

In addition, several types of utility lights are known that are incorporated into posts or railings. U.S. Pat. Nos. 2,498,942 and 1,298,362, for example, disclose lamps incorporated into the rails or bedstead of a bed. U.S. Pat. No. 2,825,796 shows a cyclone fence with lights incorporated into the fence posts. U.S. Pat. No. 4,515,393 shows a roll bar equipped with a neon light. U.S. Pat. No. 3,544,782 shows a highway guard rail assembly with lights incorporated into the rails. U.S. Pat. No. 4,161,769 shows a handrail assembly with lights incorporated into the handrails.

Various types of ultraviolet lights are also known. For example, portable ultraviolet lights have long been used by mineralogists to locate fluorescent minerals. Ultraviolet lights are also commonly used in electric bug traps ("bug zappers"), where they serve the purpose of luring insects into the trap.

While these various prior art lights may be suitable for the particular purposes for which they were intended, none are particularly suitable for use on a boat as an aid to night fishing. For example, the bulbs in the illuminated handrail of U.S. Pat. No. 4,161,769 are oriented directly downward so that they light the area in the immediate vicinity of the rail. While this is suitable for purposes such as lighting a footpath, a light useful for night fishing on a boat must be directed away from the deck of the boat so that it will illuminate the water in the immediate vicinity of the hull.

Another problem with the lighting systems of the prior art is that they utilize white or fluorescent lights. While such lights have been used at times to attract fish to fishing vessels, they are not desirable in instances where the primary purpose of the light is not to attract fish, but to illuminate fishing lines. For example, on party boats where several fishermen are fishing at the same time, it is desirable for the fishermen to be able to follow their lines into the water in order to avoid entanglement with the lines of others. White or fluorescent light is unsuitable for this purpose, since most types of fishing line appear transparent or translucent in such light.

Since fluorescent fishing line is widely available, it has become the practice of many night fishermen to hang portable ultraviolet lights on their vessels. The ultraviolet light causes the pigment in fluorescent fishing line to fluoresce, thereby rendering the line clearly visible. However, portable lights are undesirable on a boat, where the wind and the constant movement of the boat can cause such lights to detach from their temporary moorings or to broken against the side of the boat.

While most boats are equipped with light fixtures, these fixtures are typically unsuitable for use with ultraviolet bulbs. First of all, ultraviolet lights are generally tubular, are not available in a wide variety of sizes, and require a fixture that will accept a multiple prong configuration. Thus, most light fixtures that are used on boats will not accept a fluorescent bulb. In addition, ultraviolet lights require a special housing. For example, many of the materials used with white or fluorescent lights are not compatible with ultraviolet light. Many such materials are not transparent to ultraviolet light, or will melt or deteriorate upon exposure to ultraviolet light. Finally, it is well known that exposure of the eyes to ultraviolet light can cause retinal damage. Therefore, it is not desirable to mount ultraviolet lights in fixtures located on the interior of a boat, since such light must then shine past persons on deck in order to illuminate the area in the vicinity of the hull. However, the exterior of a boat is not typically fitted with a fixture suitable for accommodating an ultraviolet bulb.

There is thus a need for an ultraviolet fishing light which may be permanently mounted to the exterior of a boat, which properly illuminates fluorescent fishing line disposed in the immediate vicinity of the hull of a boat, and which does not expose the user to harmful ultraviolet rays. These and other needs may be met by the present invention as described below.

SUMMARY OF THE INVENTION

The present invention is an ultraviolet fishing light that is incorporated into a handrail that may be permanently mounted on the deck of a fishing vessel. The rail is constructed so that the ultraviolet light faces outward from the hull of the boat and causes fluorescent fishing line disposed in the immediate vicinity of the hull to fluoresce. Because the light shines outward from the handrail of the boat, it does not expose persons on the deck of the boat to the ultraviolet rays.

DETAILED DESCRIPTION OF THE PREFERRED EMBODIMENT

Figure 1:
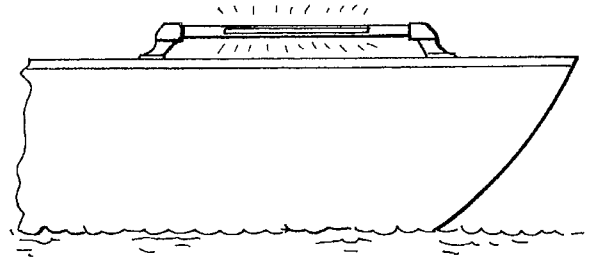
FIG. 1 is a side view of the handrail of the present invention shown mounted on a boat.

As shown in FIG. 1, the present invention is a handrail that may be mounted to the deck of a boat. The handrail provides ultraviolet illumination in the immediate vicinity of the boat for inducing fluorescence in fluorescent fishing line used in night time fishing.

Figure 2:
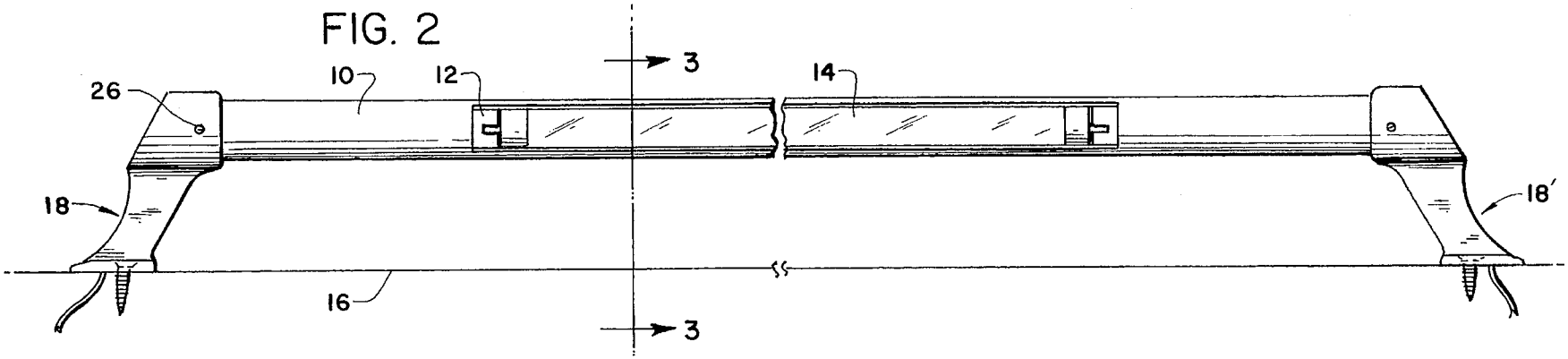
FIG. 2 is a close-up side view of the handrail shown mounted on a surface.
Figure 3:
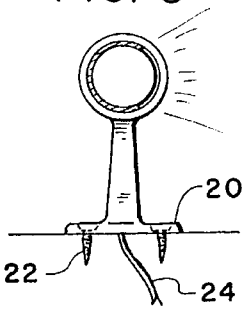
FIG. 3 is a cross section taken along line 3—3 of FIG. 2.

FIG. 2 shows the handrail in greater detail. The handrail consists of a tubular rail 10 provided with a longitudinal aperture 12 that houses an ultraviolet bulb 14. The rail is supported over a surface 16 by means of spaced mounts 18, 18'. As shown in FIG. 3, the mounts are provided with a base plate 20 that has one or more holes. The mounts are attached to the surface by a screw, bolt, rivet, or other suitable attachment means 22 which is inserted through the holes.

The handrail is preferably hollow and is provided internally with wiring and connector plates for receiving the terminals of an ultraviolet light bulb. Such circuitry is well known to the art and need not be recited in detail here. The circuitry is connected to a power source by one or more lead wires 24 which are preferably threaded through the interior of one or more of the mounts to shield the wiring from the elements and to achieve a better aesthetic effect.

Any bulb that emits light primarily in the invisible portion of the ultraviolet region of the spectrum may be used in the handrails of the present invention. However, it is preferred that the bulb used emits light primarily in that region of the ultraviolet spectrum that is sufficient to induce fluorescence in the pigments used in ultraviolet fishing line, while at the same time being of a frequency that is least harmful to human eyes.

Referring again to FIG. 2, each mount is provided with a cylindrical depression for receiving one end of the rail. The ends of the rail are preferably fixed in a particular orientation by fastening means 26. The mounts and the rail may be made of any suitable material, a preferable material being stainless steel. The interior of the handrail adjacent the aperture may be fitted with a reflector thereby increasing the luminosity of the bulb.

Figure 4:
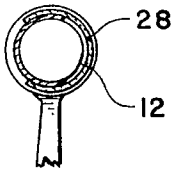
FIG. 4 is a cross section of an embodiment of the handrail in which the aperture in the handrail is covered by a UV-transparent material.

As shown in FIG. 4, the rail may be provided with a cover 28 to cover the aperture and protect the bulb from the elements. The cover is preferably made of a material that is UV compatible, i.e., a material that will not melt, deform, decompose, or otherwise degrade upon prolonged exposure to ultraviolet light. The covering is preferably waterproof and may be designed to removably snap into place over the aperture and allow easy replacement of the UV bulb. Alternately, the covering may be permanently fixed in place with a seal, and the circuitry within the rail may be disposed so as to allow the bulb to be replaced by sliding it through the end of the rail.

The aperture 12 in the rail may be of various shapes and designs, and there may be more than one aperture in a rail. However, the aperture must be oriented in such a way as to cause the ultraviolet light to shine away from the side of the boat, as shown in FIG. 1.

Figure 5:
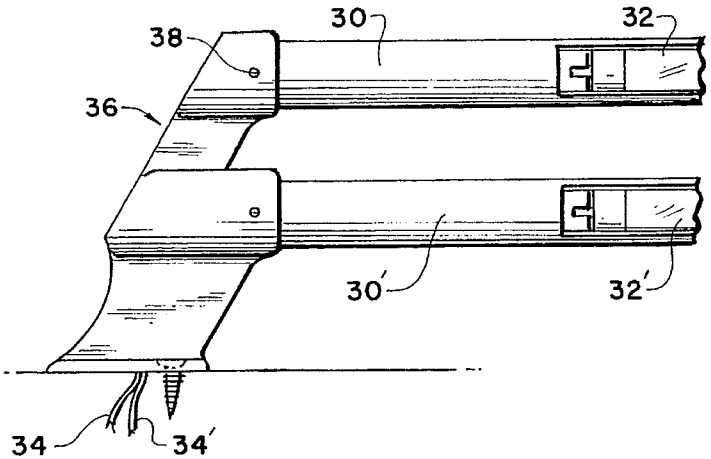
FIG. 5 is a side view of a portion of second embodiment of a handrail in accordance with the invention.

FIG. 5 shows an alternate embodiment of the present invention. In this embodiment, the device is provided with two parallel rails 30, 30' each of which is equipped with an ultraviolet bulb 32, 32'. Each rail may be provided with its own independent circuitry and lead wires 34, 34'. Alternately, the circuitry of each rail may be connected to a common lead wire. The rails are supported on double mounts 36 that support the rails in parallel. As with the first embodiment, the rails are fixed in a particular orientation by a nut, screw, or similar fastening means 38.

The handrails of the present invention are used in combination with fluorescent fishing line, many types of which are known to the art and are available commercially. In use, the handrails are installed along the edges of the deck of a boat, and are illuminated during night time fishing activities. The bulbs within the handrails shine outward from the hull of the boat and cause the pigment in the fishing line to fluoresce. This allows the user to visually ascertain the position of his fishing line in the water, and to avoid entanglement of his line with the lines of others.

The above disclosure is intended only to convey an understanding of the present invention to those skilled in the art, and is not intended to be limiting. It will be appreciated that various modifications to the disclosed embodiments are possible without departing from the scope of the invention. Therefore, the scope of the present invention should be construed solely by reference to the appended claims.

I claim:

1. A handrail useful as an accessory for night fishing, said handrail comprising:

a rail;

an ultraviolet bulb housed within said rail; and mounting means for mounting said rail on a boat.

2. The handrail of claim 1, further comprising:

circuit means, disposed in the interior of said handrail, for connecting said bulb to a power source.

3. The handrail of claim 2, wherein said circuit means includes a lead wire that is threaded through the interior of said mounting means.

4. The handrail of claim 1, further comprising:

direction means for directing the light emitted by said bulb in a particular direction.

5. The handrail of claim 4, further comprising:

orientation means for adjusting the orientation of said direction means.

6. The handrail of claim 5, wherein said handrail is mounted along a edge of a deck of said boat, and wherein said direction means is oriented so as to cause said ultraviolet bulb to shine in a direction outward from the side of the boat.

7. The handrail of claim 1, wherein said rail is tubular in shape.

8. The handrail of claim 1, wherein said mounting means comprises receiving means for receiving ends of said rail, and attaching means for attaching said receiving means to said boat.

9. The assembly of claim 1, wherein there are a plurality of said rails, at least two of which are substantially parallel to each other.

10. The handrail of claim 1, wherein said bulb is housed within an aperture in said rail.

11. The handrail of claim 10, further comprising:

cover means for covering said aperture, wherein said cover means is substantially transparent to ultraviolet radiation.

12. The handrail of claim 11, wherein said cover means is waterproof.

13. A handrail useful as an accessory for night fishing, said handrail comprising:

a hollow, tubular rail provided with a longitudinal aperture;

a pair of mounts, each equipped with (a) a base provided with attachment means for attaching said base to a surface of a boat, (b) an elongated arm extending from said base, and (c) receiving means, mounted on said arm, for receiving an end of said handrail;

an ultraviolet bulb disposed within said aperture;

cover means for covering said aperture, wherein said cover means is substantially transparent to ultraviolet radiation;

circuit means, housed within said handrail, for connecting said bulb to a power source; and orientation means for controlling the orientation of said rail.

14. The handrail of claim 13, wherein there are a plurality of hollow, tubular rails, each provided with a longitudinal aperture, and wherein at least two of said rails are substantially parallel to each other.

* * * * *